United States Patent [19]

Wheeler

[11] Patent Number: 4,748,785

[45] Date of Patent: Jun. 7, 1988

[54] SUPPORT MEMBER FOR REINFORCING STEEL

[76] Inventor: Charles F. Wheeler, 6141 N.W. 34 Way, Ft. Lauderdale, Fla. 33309

[21] Appl. No.: 9,785

[22] Filed: Feb. 2, 1987

[51] Int. Cl.[4] ..... E04C 5/16

[52] U.S. Cl. ..... 52/677; 52/687; 52/712; 249/219.1

[58] Field of Search ..... 52/295, 432, 442, 677, 52/699, 687–689, 319, 633, 712, 243, 251, 252, 410; 24/116 A, 236, 237, 586, 685; 249/30, 86, 91, 207, 216–218, 219 R

[56] References Cited

U.S. PATENT DOCUMENTS

| | | | |
|---|---|---|---|
| 593,748 | 11/1897 | Lapsley et al. | 24/237 |
| 693,213 | 2/1902 | Bajohr | 52/677 |
| 946,779 | 1/1910 | Hubbell | 174/138 B |
| 1,620,501 | 3/1927 | Vogel | 52/686 |
| 1,623,252 | 4/1927 | Konrad | 52/687 |
| 1,631,787 | 6/1927 | Bennett | 52/354 |
| 1,651,946 | 12/1927 | Burrell | 52/679 |
| 1,659,795 | 2/1928 | White | 52/684 |
| 1,672,852 | 6/1928 | Roughan | 52/677 |
| 1,882,499 | 10/1932 | Johns | 52/687 |
| 1,924,724 | 8/1933 | Olney | 52/379 |
| 2,194,834 | 3/1940 | Nealon | 52/706 |
| 2,358,147 | 9/1944 | Colburn | 52/329 |
| 2,419,317 | 4/1947 | Hall | 248/73 |
| 2,508,093 | 5/1950 | Bithell | 52/243 |
| 3,114,221 | 12/1963 | Eriksson | 52/684 |
| 3,194,525 | 7/1965 | Trumbull | 248/74.2 |
| 3,225,506 | 12/1965 | Aberg | 52/701 |
| 3,292,401 | 12/1966 | Van Meter | 70/459 |
| 3,300,930 | 1/1967 | Weise | 52/309.1 |
| 3,317,167 | 5/1967 | Becker et al. | 248/73 |
| 3,367,084 | 2/1968 | Reiland | 52/689 |
| 3,464,661 | 9/1969 | Alesi, Jr. | 248/68.1 |
| 3,471,987 | 10/1969 | Yelsma | 52/684 |
| 3,568,980 | 3/1971 | Hulburt | 248/74.3 X |
| 3,881,833 | 5/1975 | McMullen | 404/60 |
| 4,060,954 | 12/1977 | Liuzza | 52/677 |
| 4,061,873 | 12/1977 | Berg, Jr. et al. | 174/208 |
| 4,190,999 | 3/1980 | Hampton | 52/687 |
| 4,388,791 | 6/1983 | Anderson | 52/719 |
| 4,617,704 | 10/1986 | Kasai | 24/236 |
| 4,644,726 | 2/1987 | Wheeler | 52/677 |

FOREIGN PATENT DOCUMENTS

| | | | |
|---|---|---|---|
| 173887 | 12/1916 | Canada | 52/689 |
| 1484980 | 1/1969 | Fed. Rep. of Germany . | |

*Primary Examiner*—John E. Murtagh
*Assistant Examiner*—Andrew Joseph Rudy
*Attorney, Agent, or Firm*—Karen M. Gerken; Martin P. Hoffman; Mitchell B. Wasson

[57] ABSTRACT

A resilient support member for reinforcing steel having first and second legs separated by an open cavity and being normally axially aligned in the inoperative position of the support member. The support member is adapted to assume an operative position by deforming the legs inwardly toward each other around a reinforcing steel bar such that one of said legs is perpendicular to the other and with the reinforcing bar being disposed within the cavity which, in the operative position, is substantially closed around the bar. The support member may be secured in this operative position with the outer ends of the legs abutting the inner surface of the walls of a concrete form.

7 Claims, 2 Drawing Sheets

SUPPORT MEMBER FOR REINFORCING STEEL

CROSS REFERENCE TO RELATED PATENT APPLICATION

The subject matter of the invention herein disclosed and described is related to applicant's co-pending patent application Ser. No. 835,292, filed on Mar. 3, 1986, now U.S. Pat. No. 4,644,726, and directed to a steel placement assembly.

BACKGROUND OF THE INVENTION

1. Field of the Invention

The invention broadly pertains to means for positioning and securing reinforcing steel in a variety of concrete structural members, such as reinforced concrete columns and beams.

More specifically, the invention is directed to a unique support member for reinforcing steel bars whereby the steel reinforcement is accurately located within a concrete structural member and is positively restrained from undesirable axial or rotational movement during placement of the concrete.

A critical element of reinforced concrete design involves the accurate placement and support of the reinforcing steel bars in the concrete structural member. It is essential that the reinforcing steel be precisely located and supported the required distance inside the face of the concrete. Failure to maintain the reinforcing steel a sufficient distance inward of the face of the concrete results in detrimental oxidation of the steel reinforcement, thereby significantly compromising the integrity of the structural member and necessitating exceedingly costly and extensive restoration of the structure. The support member of the instant invention addresses and eradicates the normally prevalent problem of oxidation associated with reinforced concrete members by insuring accurate location of the steel reinforcement the optimum distance inside the face of the concrete.

The detrimental effects of oxidation can only be entirely prevented when the reinforcing steel is not only accurately positioned inside the concrete face, but when the reinforcing steel is also restrained from axial and rotational movement during placement of the concrete so as to prevent unwanted shifting of the steel from its required position. Moreover, the integrity of a concrete structural member is determined by how effectively the reinforcing steel bars are locked in position within the concrete form to prohibit shifting of the steel when the concrete is placed. The subject support member positively prevents undesirable movement of the reinforcing steel from design parameters and thereby enhances the design efficiency of architects and engineers for reinforced concrete structures. The attributes in design and placement of the reinforcing steel realized through utilization of the reinforcing steel support member of the present invention result in lower costs of construction and maintenance for reinforced concrete structures.

The foregoing objects are achieved with the present invention in the form of a support member for reinforcing steel, which support member lends itself for utilization in locating and positioning both horizontal and vertical reinforcing steel the required distance inward of the concrete form. The invention further contemplates the utilization of a second reinforcing steel placement member particularly adapted for positioning the horizontally disposed top and center steel reinforcement in structural members such as beams, slabs and the like. Moreover, the instant support member is advantageous for its heretofore unparalleled simplicity and economy and may be easily formed to accommodate various sizes of reinforcing steel and diverse spacing requirements.

2. Description of the Prior Art

It is known in the prior art to provide supports, or chairs, for reinforcing steel rods disposed horizontally in a concrete structural member. Supports of this general type are disclosed in U.S. Pat. No. 1,620,501; U.S. Pat. No. 1,659,795 and U.S. Pat. No. 3,881,833.

U.S. Pat. No. 1,620,501, issued Mar. 8, 1927 to Vogel, teaches a concrete reinforcing rod chair for supporting lower and upper reinforcing rods comprising a wire rod that is laterally bent to form an upper portion and two uprights with U-shaped loops providing seats for the rods.

U.S. Pat. No. 1,659,795, issued Feb. 21, 1928 to White, discloses a bar chair including two sections of wire which are bent and assembled to form a stable tripod having a pocket at the upper end for receipt of a reinforcing bar.

U.S. Pat. No. 3,881,833, issued May 6, 1975 to McMullen, teaches a wire frame structure for supporting dowels in pavement sections. The wire frame structure comprises a plurality of rod supporting elements which are characterized by upright legs and loops or hooks for receipt of the dowels.

It is also known in the prior art to support steel reinforcing bars, disposed transverse to each other, in a concrete member. Examples of this type of reinforcement supporting means are shown in U.S. Pat. No. 1,623,252; U.S. Pat. No. 1,651,946 and U.S. Pat. No. 4,388,791.

U.S. Pat. No. 1,623,252, issued on Apr. 5, 1927 to Konrad, discloses reinforcing means including a plurality of interconnected longitudinal and transverse bars.

U.S. Pat. No. 1,651,946, issued Dec. 6, 1927 to Burrell, is directed to a bar support comprising a spiral bight through which a reinforcing bar is adapted to be projected and a leg formed on each end of the bight. Each leg is provided with a pocket for projecting therethrough a transverse reinforcing rod.

U.S. Pat. No. 4,388,791, issued June 21, 1983 to Anderson, teaches a rebar tie comprising an elongated member having a curved mid-portion for seating on a vertical rebar, and a pair of parallel legs which clip onto horizontal rebars.

Furthermore, a locator for vertical reinforcing bars is shown in U.S. Pat. No. 4,190,999, issued on Mar. 4, 1980 to Hampton. Disclosed therein is a locator of ladder-like configuration and having circular rings for receiving vertical reinforcing bars.

The prior art fails to disclose a simple, unitary support member of the type disclosed by the subject invention which is capable of accurately positioning horizontal and/or vertical reinforcing steel in relation to a concrete form and effectively restraining said reinforcing steel from axial and rotational movement.

SUMMARY OF THE INVENTION

The present invention is directed to a support member for the reinforcing steel of a concrete structural member, such as columns, beams and the like. The invention comprises an integrally molded and resilient support member which, in the unassembled condition, includes a first leg and a second leg connected together by means of a planar portion of reduced thickness. Each of the legs has an inner edge in the form of a semi-circular recess which, together with the planar portion, define a cavity open on one side. The outer edge of each leg is provided with an end flange adapted to abut the inner surface of a wood form. One of the legs is provided with a bottom extension and the other leg is provided with a top extension. A through hole is provided in each of the top and bottom extensions. The support member is adapted to assume an operative or assembled position achieved by manually deforming the legs toward each other around a reinforcing bar disposed within the open cavity until one of the legs is perpendicular to the other. In this position, the top and bottom extensions, and their respective through holes, are in alignment. The support member may be maintained in this operative position by means of a nail or other similar means being projected into the aligned through holes. The support member may be formed with legs of different lengths in order to locate the reinforcing steel at various positions inside the concrete face. The open cavity may be formed of diverse size in order to accommodate reinforcing steel bars of various diameters.

The invention further contemplates a steel placement member for center and top reinforcing steel in reinforced concrete beams and walls. The steel placement member comprises an elongated body having a perpendicular leg at one end and a curved portion at the opposite end. The perpendicular leg is adapted to abut the inner surface of a concrete form with the curved portion being adapted to be clipped onto a reinforcing steel bar to support and locate the bar. The length of the body portion and the size of the curved portion may be formed so as to accommodate various locations and sizes of reinforcing steel.

DESCRIPTION OF THE PREFERRED EMBODIMENT

Figure 1:
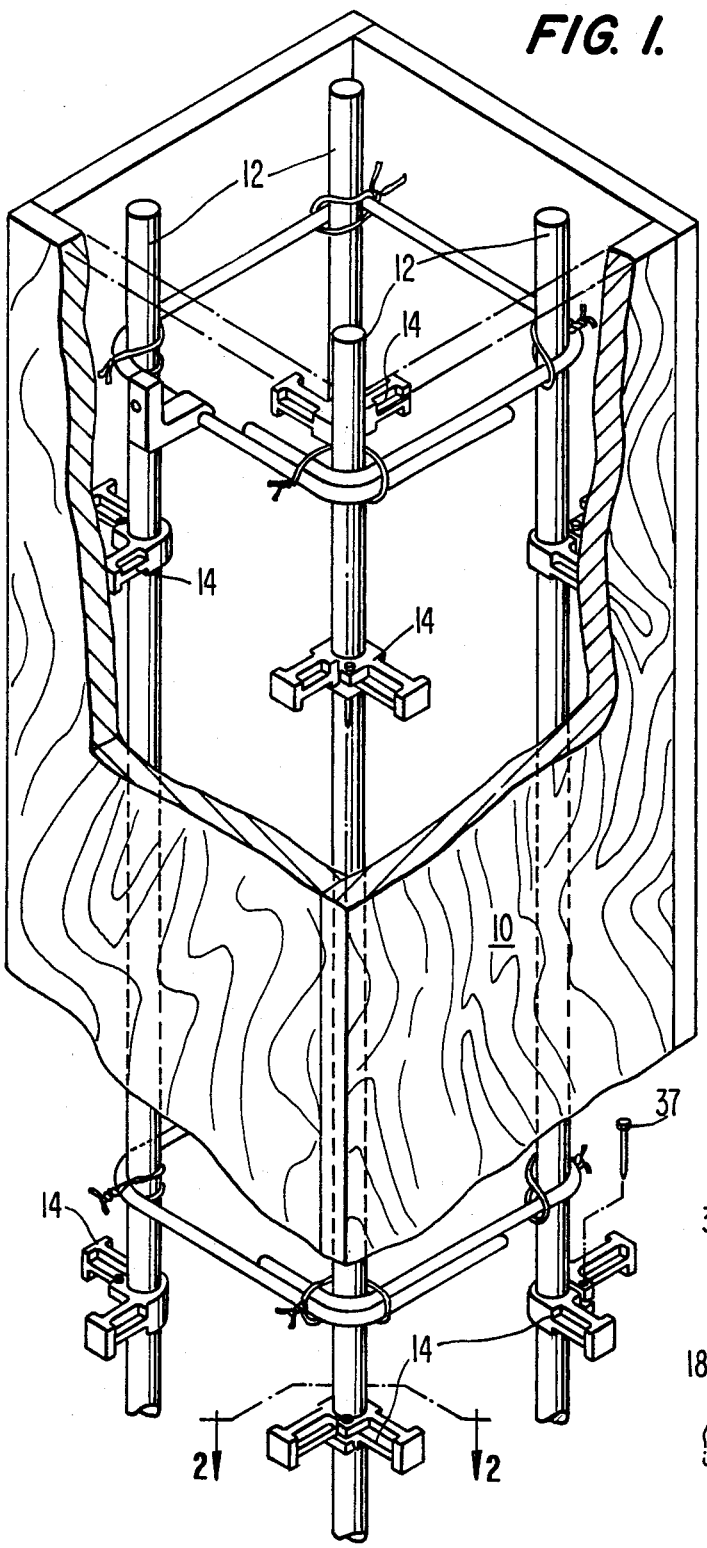
FIG. 1 is a perspective view of a column utilizing the reinforcing steel support member of the present invention with a portion of the wood form shown partially broken away.
Figure 8:
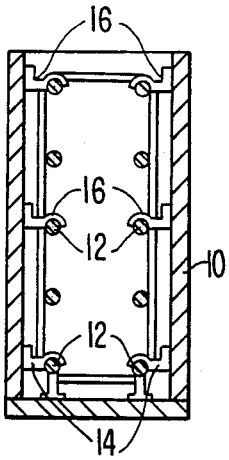
FIG. 8 is a side elevational view of a beam utilizing the reinforcing steel support member and the steel placement member of the present invention.

Referring to FIG. 1, there is shown a wood form 10 defining a vertical column prior to placement of concrete. A plurality of vertical reinforcing steel bars 12 is disposed within the form to provide reinforcement for the concrete column produced by placement of concrete within the form. The diameter of the reinforcing steel bars may vary for different concrete structural members, the diameter being determined by diverse load criteria applicable to the particular structural member. The particular design criteria also dictate the location of the reinforcing steel bars within the form. In general, the reinforcing steel bars must be located and maintained a minimum distance inside the face of the concrete and, hence, the chair. Additionally, design parameters will require a specific center to center distance between the reinforcing bars themselves. Thus, means must be provided in the concrete form for locating the reinforcing steel bars the requisite distance inside the concrete face, as well as positioning the steel reinforcing bars with respect to each other. FIG. 8 illustrates a side elevational view of a beam defined by wood form 10 and having a plurality of reinforcing bars 12 positioned therein. The column of FIG. 1 an the beam of FIG. 8 are each provided with reinforcing steel support members 14 for locating and positioning the reinforcing steel with respect to the wood form. Additionally, the beam of FIG. 8 is provided with second reinforcing steel placement members 16 for locating and positioning the top and center steel reinforcement.

Figure 2:
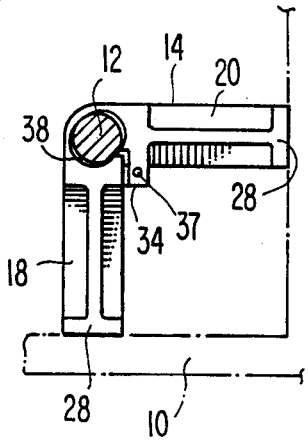
FIG. 2 is a top plan view of one of the reinforcing steel support members of FIG. 1 taken through line 2—2 of FIG. 1.
Figure 3:
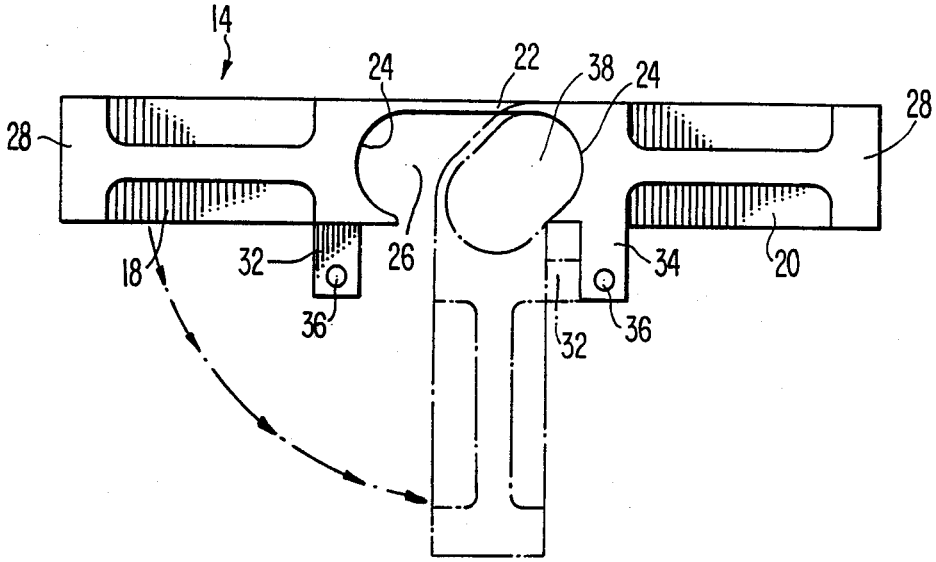
FIG. 3 is an exploded top plan view of the reinforcing steel support member of FIG. 2. showing the support member in its unassembled condition.
Figure 4:
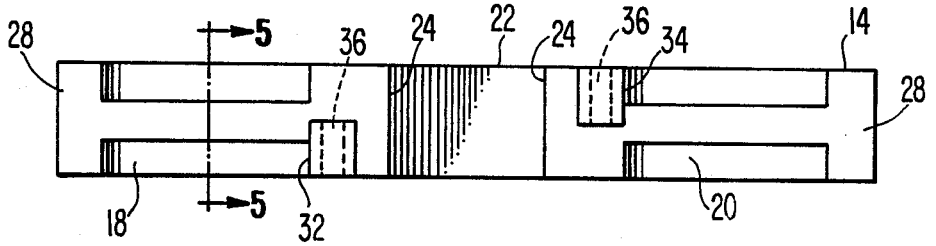
FIG. 4 is a side elevational view of the reinforcing steel support member of FIG. 2.

A reinforcing steel support member 14 is depicted in FIGS. 2-5. The support member 14 is integrally formed as a unitary member of a somewhat flexible, somewhat resilient, polymer material by conventional molding techniques. The support member is formed such that its normal position is that depicted in FIGS. 3 and 4. As illustrated in FIGS. 3 and 4, the support member 14 comprises a first leg 18 and a second leg 20 connected at one side by means of a generally planar portion 22 of reduced thickness. The planar portion 22 is integral, at each end, with identical semicircular edges 24. Edges 24 form the inner end of each of the legs 18,20 and, together with planar portion 22, define a cavity 26, open at the side opposite planar portion 22, which lies between the respective legs 18,20. The outer ends of the legs 18,20 each terminate in a generally flat end flange 28 normal thereto. Each flange 28 is adapted to abut the inner surface of the wood form, as shown in FIG. 1.

Figure 5:
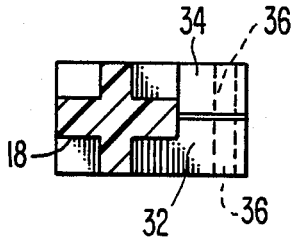
FIG. 5 is a vertical cross sectional view of the reinforcing steel support member of FIG. 4 taken through line 5—5 of FIG. 4.

With reference to FIGS. 3, 4 and 5, it can be seen that the first leg 18 is provided along its bottom portion with an integral extension 32. Bottom extension 32 projects outwardly from the bottom portion of the first leg 18, as illustrated in FIGS. 3 and 5, and extends for a distance upwardly until it terminates generally half-way up the leg 18 when said leg is viewed from the side as depicted in FIG. 4. Second leg 20 is provided along its upper portion with a similar integral extension 34. Top extension 34 projects outwardly from the top portion of the second leg 20 and extends for a distance downwardly until it terminates generally half-way down the leg 20. Extensions 32 and 34 are each provided with a through hole 36 for a purpose to be herein described. Bottom extension 32 may, alternatively, be provided on second leg 20 with top extension 34 being provided on first leg 18.

The configuration of FIGS. 3 and 4 illustrates the support member 14 in its normal inoperative or unassembled position. When it is desired to utilize the support member 14 for locating and restraining a reinforcing steel bar 12 within a wood form 10, the support member 14 must be manually deformed by the user to the operative or assembled position of FIG. 1. This operative position is achieved by the user deforming the first leg 18 inwardly toward the open side of cavity 26 and toward the second leg 20, as shown by the broken lines of FIG. 3. This deformation is possible due to the inherent resiliency of the support member 14. When the first leg 18 is perpendicular to second leg 20, the extensions 32 and 34 and their respective through holes 36 will be axially aligned as depicted in FIG. 5. The first and second legs 18,20 may be secured in this operative or assembled position by means of a nail 37, screws, or the like, being inserted into the aligned through holes 36 of aligned extensions 32 and 34.

As is best illustrated in FIGS. 1, 2 and 3, the operative position of the support member 14 results in substantial closure of the open side of cavity 26. As a result, a generally circular opening 38 is created between the perpendicular legs 18,20 for accommodation of a reinforcing bar 12 projecting therethrough. It should be noted that, in practice, the leg 18 may preferably be deformed to the operative position by disposing a reinforcing bar 12 within the open cavity 26 and bending leg 18 directly around the bar within the wood form 10 and then securing the support member in the operative position. It is also of import to note that it is of no consequence to operation of the instant support member if second leg 20 is inwardly bent toward first leg 18. Either or both legs may be bent toward each other to close cavity 26 and to align extensions 32,34 and their through holes 36 due to the resiliency of the support member.

It can be seen in FIGS. 1 and 8 that the support member 14, in the assembled position, may be located in the wood form 10 so as to have each of the end flanges 28 abutting the inner surfaces of adjacent perpendicular walls of the wood form. In this manner, the reinforcing steel bar 12 is located inside the wood form and, thus, the concrete face, a distance determined by the length of the first and second legs 18,20, respectively. The support member 14 may, therefore, be formed such that the legs 18 and 20 are of a variety of lengths in order to accommodate diverse applications and required spacing distances. A significant feature of the present invention is that the first leg 18 need not be the same length as the second leg 20. It is then possible to position the reinforcing steel bar 12 such that it is located a first distance inside the concrete face with respect to a first wall of the wood form and a second different distance inside the concrete face with respect to a second wall of the form perpendicular to the first wall.

An additional salient feature of the invention is that the semicircular edges 24 and, hence, the cavity 26, may be formed larger or smaller in order, in the assembled position, to form circular openings 38 which are able to accommodate reinforcing steel bars of a variety of diameters. It is thus possible to form the support member 14 so as to meet diverse design criteria regarding the size and placement of the reinforcing steel. As illustrated in conjunction with FIGS. 1 and 8, the support member 14 is equally adept at supporting vertically and horizontally disposed reinforcing bars.

It is to be noted that, in the operative position of the support member 14 shown in FIG. 1, the opening 38 which accommodates the reinforcing steel bar 12 is such as to hold the steel firmly therein. As a result of this very secure connection between the support member 14 and the steel 12, the end flanges 28 are able to abut the wood form and to be held securely thereagainst without the need for any securing means. Because of the perpendicular configuration of the legs 18 and 20 in the operative position, axial and rotational movement of the support member 14 and, hence, the steel bar, is prohibited when the concrete is placed.

Thus, in addition to positively locating a steel reinforcing bar the optimum distance inside the concrete face, the support member 14, which surrounds the perimeter of the reinforcing bar, effectively restrains the reinforcing bar and prohibits it from axial and rotational movement within the form as the concrete is being placed therein. The support member consequently prohibits unwanted and potentially detrimental sifting of the reinforcing steel while the concrete is placed.

Figure 6:
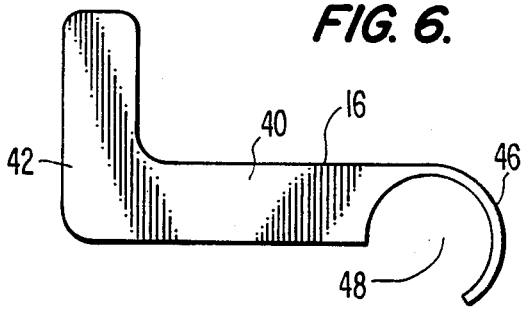
FIG. 6 is an exploded side elevational view of the steel placement member of FIG. 1.
Figure 7:
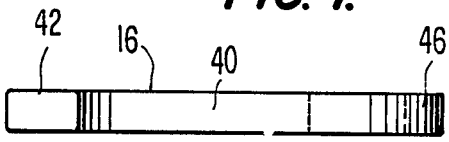
FIG. 7 is a top plan view of the steel placement member of FIG. 6.

As illustrated in FIG. 8, certain structural members, such as beams and walls, require center, or even top, reinforcing steel bars. In these situations, the present invention contemplates the utilization of the reinforcing steel placement members 16 depicted in FIGS. 6, 7 and 8, and in particular, in FIGS. 6 and 7. As best shown in FIGS. 6 and 7, the placement member 16 comprises an elongated planar body portion 40, one end of which is integral with a vertical perpendicular leg 42. Leg 42 extends upwardly from body portion 40. The opposite end of the body portion 40 is provided with an integral curved portion 46 which defines a generally circular recess 48 having an open portion sufficient in size to allow the curved portion 46 to clip onto a reinforcing steel bar 12.

As shown in FIG. 8, in the case of a large beam, where top and center steel bars are required, the placement members 16 are utilized to support and stabilize the top and center steel. In the case of a smaller beam, only top steel is required and the placement members 16 are intended to be utilized thereon. The reinforcing steel support members 14 are utilized on the bottom steel as previously discussed herein.

As was discussed previously in connection with the reinforcing steel support member, the placement member 16 is formed of a semi-resilient styrene. Furthermore, the placement member 16 may be formed having the planar body portion 40 of diverse lengths so as to achieve different placement distances for the reinforcing steel bars in relation to the concrete form. The curved portion 46 may also assume diverse sizes to provide larger and smaller circular recesses 48, as the case may be, to accommodate reinforcing bars of different diameters.

It is to be noted that the circular recess 48 is configured such as to allow the curved portion 46 to clip onto the steel bar 12 and be firmly held thereon. Consequently, the vertical perpendicular leg 42 is able to abut the wood form and to be held securely thereagainst without the need for any securing means. The vertical leg thereby serves to prevent undesired axial and rotational movement of the steel bar during placement of the concrete.

While the invention has been described in detail in connection with a preferred embodiment, it is to be understood that various modifications to the details of construction may be made without departing from the spirit and scope of the invention as defined in the appended claims.

What is claimed is:

1. A support member for reinforcing bars, said support member comprising a first leg and a second leg, each of said legs being defined by an inner end, an outer end, a first side and a second side, a planar portion of reduced thickness extending from the first side of one of said legs to the first side of the other of said legs so as to connect said legs together, each of said inner ends being defined by a semi-circular edge, each of said semicircular edges extending from said planar portion to said second side of said respective leg, said semicircular edges being oppositely facing, said support member being adapted to assume a normally inoperative position wherein said first and second legs are substantially axially aligned and wherein said planar portion and said inner ends together define an elongated cavity lying between said inner ends, said cavity having an open part between said inner ends opposite said planar portion, said support member being adapted to assume an operative position wherein one of said legs is substantially perpendicular to the other of said legs and said cavity is substantially closed whereby said inner ends and said planar portion form a generally circular opening enclosed by said planar portion and said inner ends for receiving and gripping a reinforcing bar, and means for securing said legs in said operative position, said support member being adapted to be disposed within a form for a concrete structural member with said outer ends of said legs abutting said form.

2. The support member recited in claim 1 wherein each of said outer ends of said legs is provided with an end flange for abutting said form.

3. The support member recited in claim 1 wherein one of said legs is provided with a bottom extension and the other of said legs is provided with a top extension, each of said extensions having a through hole formed therein, each of said extensions being provides proximate said inner end of said respective leg and projecting outwardly from said second side of said leg, said bottom and top extensions and said through holes being adapted to be vertically aligned when said support member is in said operative position.

4. The support member recited in claim 3 wherein said means for securing said support member in said operative position is a nail projecting through said aligned through holes.

5. The support member recited in claim 3 wherein each of said second sides has a vertical height and said top and bottom extension each have a vertical height approximately equal to one half said vertical height of said second sides.

6. The support member recited in claim 1 wherein said operative position is achieved by manually deforming said member to cause said legs to be brought toward each other around said open part of said cavity until said legs are substantially perpendicular to each other.

7. The support member recited in claim 1 wherein said member is formed as a unitary molding of semi-resilient styrene material.

* * * * *